United States Patent [19]

LaTourrette

[11] 4,091,344

[45] May 23, 1978

[54] MICROWAVE MULTIPLEXER HAVING RESONANT CIRCUITS CONNECTED IN SERIES WITH COMB-LINE BANDPASS FILTERS

[75] Inventor: Peter Myers LaTourrette, Los Altos, Calif.

[73] Assignee: Wavecom Industries, Sunnyvale, Calif.

[21] Appl. No.: 760,697

[22] Filed: Jan. 19, 1977

[51] Int. Cl.[2] ..... H01P 1/20; H01P 5/12

[52] U.S. Cl. ..... 333/73 S; 333/9

[58] Field of Search ..... 333/6, 8, 9, 73 C, 73 S

[56] References Cited

U.S. PATENT DOCUMENTS

| | | | |
|---|---|---|---|
| 2,076,248 | 4/1937 | Norton | 333/8 |
| 2,249,415 | 7/1941 | Bode | 333/6 |
| 4,003,005 | 1/1977 | Mukherjee et al. | 333/8 |

OTHER PUBLICATIONS

G. L. Mattaei & E. G. Cristal, *Theory & Design of Diplexers & Multiplexers,* in *Advances in Microwaves,* vol. 2, edited by Leo Young, Academic Press, 1967, pp. 237–326.

Edward G. Cristal, *Capacity Coupling Shortens Comb--Line Filters,* in Microwaves Dec. 1967, pp. 44–50.

*Primary Examiner*—Alfred E. Smith
*Assistant Examiner*—Harry E. Barlow
*Attorney, Agent, or Firm*—Limbach, Limbach & Sutton

[57] ABSTRACT

A microwave multiplexer having a plurality of comb-line filters tuned to pass distinct but adjacent frequency bands connected in parallel to a common input through individual resonant circuits having a minimum impedance at a frequency in the pass band of the associated comb-line filter.

13 Claims, 6 Drawing Figures

MICROWAVE MULTIPLEXER HAVING RESONANT CIRCUITS CONNECTED IN SERIES WITH COMB-LINE BANDPASS FILTERS

BACKGROUND OF THE INVENTION

This invention relates generally to microwave frequency multiplexers, particularly those of a comb-line type.

Multiplexers are utilized for dividing a common wide band signal into a plurality of distinct adjacent frequency bands. For example, consider a particular microwave circuit carrying a broad band signal that extends from 1500 MHz to 3000 MHz but which carries four separate signals independent of each other by a technique termed frequency multiplexing. By that technique, one of the four separate signals would be carried in the frequency band of 1500 to 1850 MHz, the second in the adjacent but distinct frequency band of 1850 to 2200 MHz, the third 2200 to 2600 MHz and the fourth 2600 to 3000 MHz. This single broad band signal is separated into its individual signals, by one known technique, by using a plurality of parallel connected bandpass microwave filters all having their inputs connected to that single circuit but being tuned to pass only one of the distinct signal carrying bands having a 350 or 400 MHz bandwidth. The four individual signals are separately recovered at the outputs of the bandpass filters.

Such a multiplexer is preferably made of a plurality of parallel connected comb-line filters. The comb-line type of microwave bandpass filter is generally preferred because of its ease of manufacture and wider range of tolerances than other types of microwave filters. Each of the inputs of the individual comb-line bandpass filters is connected to the single broad band signal input terminal in a manner, and with other components, so that the operation of one filter does not adversely affect the operation of the other.

The input admittance (reciprocal of impedance) of a multiplexer needs to be matched to the broad band signal circuit and remain uniform over the entire bandwidth of the circuit and filter. Maintaining the real part of the input admittance of existing multiplexers at a uniform level over this frequency range is not a particular problem, but maintaining the imaginary component of the input admittance at a uniform level is extremely difficult with existing techniques, especially when the bandwidth of the multiplexer is very large and it includes a large number of individual parallel filters. Since most circuits to which the multiplexer input is connected have an impedance with a zero imaginary admittance component over its bandwidth, such a requirement is generally the case for the input admittance of a multiplex filter as well. Otherwise, energy is undesirably reflected from the filter input. This reflection is indicated by the voltage-standing-wave-ratio (VSWR) quantity. These requirements, and several existing approaches to satisfying those requirements, are suggested by G. L. Matthaei and E. G. Cristal in an article entitled "Theory and Design of Diplexers and Multiplexers," appearing at pages 237–326 of a book *Advances in Microwaves,* Volume 2, edited by Leo Young, and published by Academic Press in 1967. However, the approaches to providing a multiplexer having an imaginary part of the input admittance being substantially equal to zero over the full bandwidth of the multiplexer are not adequate for many present requirements for a multiplexer having a plurality of separate bandpass filters and designed to operate in the microwave frequency range over 100 MHz and having a band edge frequency ratio exceeding 2 to 1.

Therefore, it is a principal object of the present invention to provide an improved microwave multiplexer structure and method of multiplexing that maintains the input VSWR within acceptable limits over those broader bandwidths at such microwave frequencies.

It is another object of the present invention to provide such a device and technique that are simply realizable and easily implemented in compact units.

SUMMARY OF THE INVENTION

These and additional objects are accomplished by the present invention wherein, briefly, a resonant circuit is placed in series between a common input terminal and at least an intermediate frequency band filter of a multiplexer having three or more bandpass comb-line filters connected in parallel. Each such resonant circuit is tuned to resonate at a frequency within the pass band of its associated comb-line filter, thus having a minimum impedance at that frequency. The lowest frequency band comb-line filter is preferably connected to the common input terminal through a series inductance only, omitting any capacitive element and thus not being a resonant circuit. Similarly, the highest frequency band comb-line filter may be connected in series with only a capacitive element to the common input terminal, if desired, to the extent that the inductance can be eliminated from the connecting lead, but such a resonant circuit is generally preferred for convenience.

This particular combination utilizes the many advantages of a comb-line filter but solves a problem that has existed in combining a plurality of such filters in parallel with an overall bandwidth having a band edge ratio in excess of 2 to 1. Although it may appear at first to be unrealizable in a practical form because the technique combines two completely different types of filters together into one filter, it has been found to indeed be practically realizable and to have a number of advantages. While the series input resonant circuit is more typical of a symmetrical type, the comb-line filter is of an asymmetrical type. The result is a multiplexer having a very low VSWR over the entire bandpass. The techniques of this invention make it possible to maintain the imaginary part of the common input multiplexer admittance at substantially zero over nearly all the entire bandwidth.

Additional objects, advantages and features of the present invention will become apparent from the following description of its preferred embodiments which should be taken in conjunction with the accompanying drawings.

DESCRIPTION OF THE PREFERRED EMBODIMENTS

Figure 1:
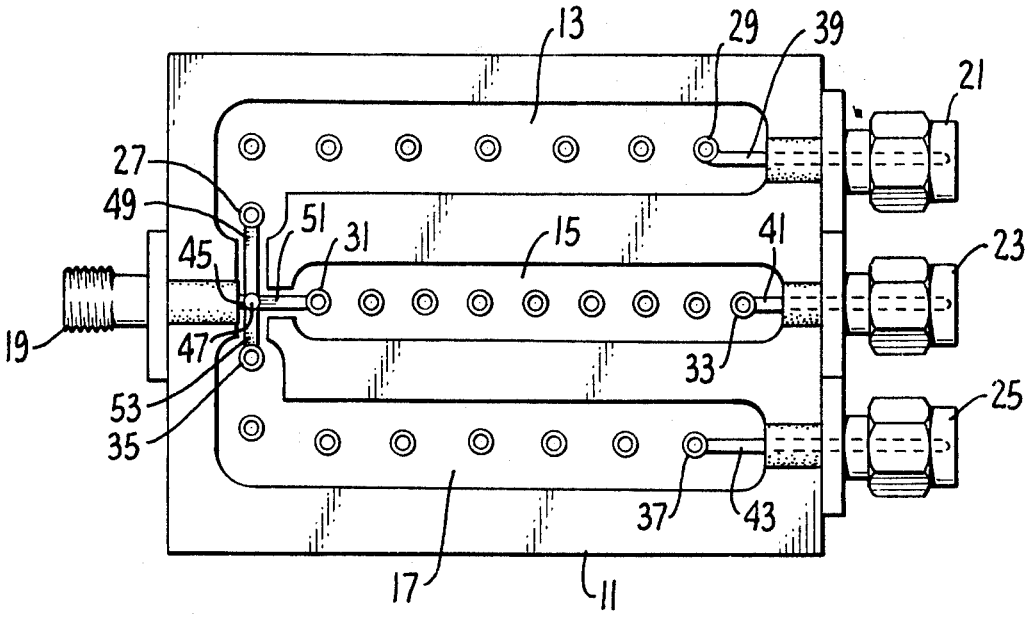
FIG. 1. PRIOR ART
FIG. 1 is a sketch of a prior art comb-line filter microwave multiplexer, shown in plan view with its cover removed.
Figure 1A:
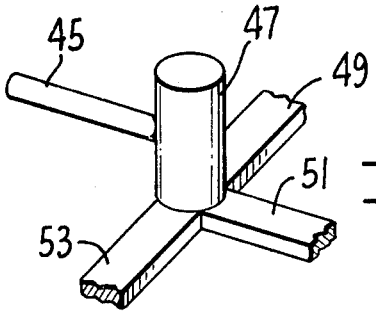
FIG. 1A is an enlarged view of a component of the filter of FIG. 1.

Referring initially to FIGS. 1 and 1A, an example of an existing microwave multiplexer is described. FIG. 1 shows in plan view a multiplexer having three parallel comb-line bandpass filters, with its cover removed. A metal aluminum base 11 has three filter channels 13, 15 and 17 machined therein. The filter has a single coaxial cable connector 19 as an input. Three separate coaxial cable output connectors 21, 23 and 25 are provided on an opposite side of the block 11.

The multiplexer of FIG. 1 is utilized by receiving a broad band microwave signal in a coaxial cable connected to its connector 19. In each of the cavities 13, 15 and 17 is formed a comb-line filter having well defined frequency bandpass characteristics. For example, the first microwave filter formed in the cavity 13 is designed by the various dimensions of the cavity itself and the elements therein to pass a first microwave frequency portion to its output connector 21. The second filter formed by the cavity 15 is then designed to pass to its output connector 23 a distinct microwave frequency portion that is immediately adjacent to and above the frequency range of the first filter. Similarly, the third comb-line filter formed in the cavity 17 passes to its output connector 25 yet another distinct microwave frequency band immediately adjacent to and higher than the pass band of the second filter.

In this way, a single circuit connected to the input 19 of the filter carries three distinct microwave signals which are frequency selected by the filters within the multiplexer and applied to separate outputs. Of course, additional comb-line filters can be added in parallel to those shown in the filter of FIG. 1 if it is desired to separate additional signals from a common broad band signal circuit.

According to well known construction of comb-line filters, the lowest frequency band filter within the cavity 13 includes a plurality of resonant stubs extending between an input resonator 27 to an output resonator 29. Similarly, the comb-line filter within the cavity 15 includes an input resonator 31 and an output resonator 33. The highest frequency pass band comb-line filter within the cavity 17 includes an input resonator 35 and an output resonator 37. An output conductor 39 within the coaxial connector 21 is connected directly to the output resonator 29 of the lowest frequency band filter. Similarly, a conductor 41 that is the center conductor of the coaxial connector 23 is solidly connected to the output resonator 23 of the second comb-line filter. The output of the third comb-line filter is also provided by a conductor 43 connected directly to the output resonator 37.

The single input to the three filters is provided initially by a single conductor 45 that is the center end of the coaxial input connector 19. This conductor 45 is solidly connected to an input junction 47. Conductors 49, 51 and 53 are solidly connected between the input junction 47 and the respective input resonators 27, 31 and 35 of the three comb-line bandpass filters. A complete multiplexer of the type shown in FIGS. 1 and 1A includes a cover that includes tuning screws therein that fit within the comb-line resonators shown in FIG. 1. Tuning screws adjust the capacitive load at one end of each of the comb-line resonators, the other end being solidly attached to the base plate 11, which is considered to be at reference or ground potential. The shield or common conductor of each of the input and output connectors is also electrically and mechanically connected as part of the base portion 11 at ground potential.

Figure 2:
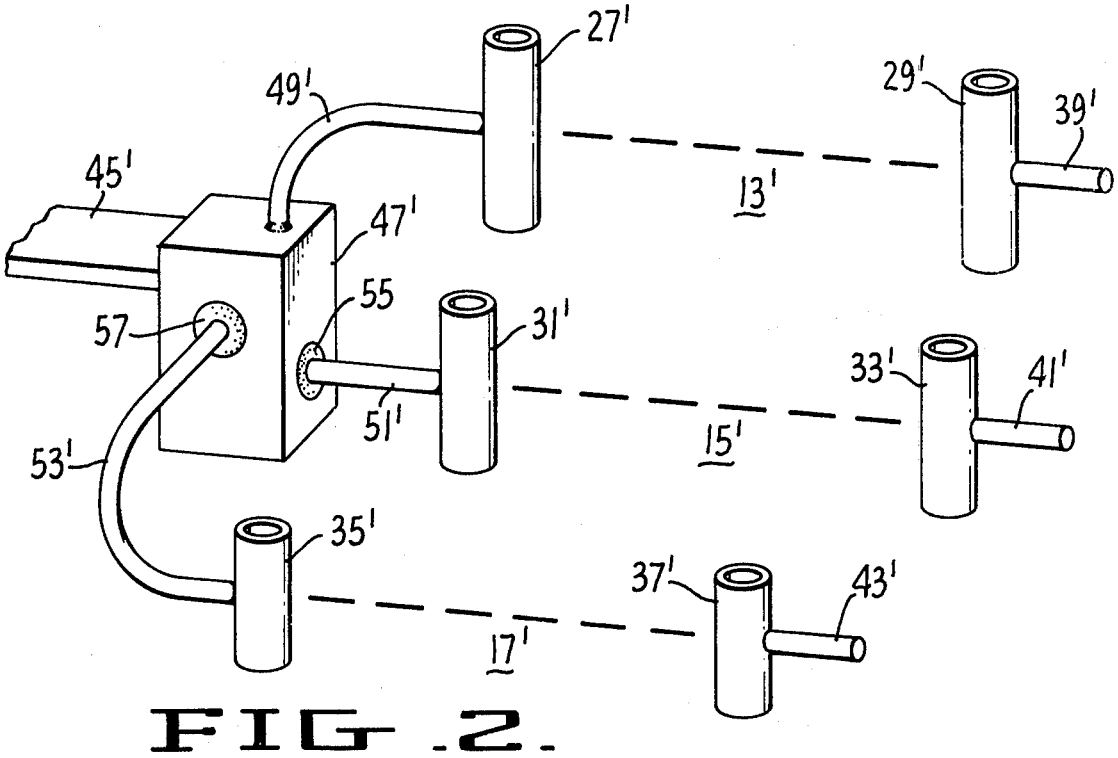
FIG. 2 illustrates a preferred embodiment of the present invention.

Referring to FIG. 2, one particular mechanical implementation of a principal aspect of the present invention is illustrated, wherein basic elements that are generally common with those of the multiplexer of FIGS. 1 and 1A are shown with the same reference number but with a prime (′) added thereto. The basic structural difference that appears to the eye is with the common input connecting block 47′ and the connection of the various input conductors 49′, 51′ and 53′ to each of the individual comb-line bandpass filters. The conductor 49′, connected at one end directly to the input resonator 27′ of the lowest frequency bandpass comb-line filter, is connected at its other end solidly to the top of the connector block 47′. No capacitance is interposed in series with this connection, in this specific example, but a capacitance is provided in series with each of the other two connector lines 51′ and 53′. This capacitance is provided by placing the input end of each of the conductors 51′ and 53′ within an aperture provided in the metal input block 47′ in a non-contacting relationship therewith. A solid insulating material then fills up the space between the conductor and the block within such an aperture, in the form of insulating material 55 and 57, in order to maintain the mechanical spacing of the two parts and introduce a controlled dielectric constant. Thus, series capacitance introduced into the connection between the input and each of the two highest frequency bandpass filters is fixed. The length of the conductors 47′, 51′ and 53′ is controlled in order to control the amount of effective inductance that is also placed in series with the input and each of the comb-line bandpass filters.

The dimensions of the conductor 51′ and its capacitive coupling with the connecting block 47′ are adjusted to provide a series capacitor and inductor resonating circuit with a resonant frequency within the bandpass of its associated comb-line bandpass filter. Similarly, the dimensions of the conductor 53′ and its capacitive coupling with the connecting block 47′ are selected to provide a resonant circuit in series with its associated comb-line filter and having a resonance at a frequency within its bandpass. If the inductance could be conveniently eliminated from the wire connection 53′, a simple capacitive coupling without inductance to the highest frequency bandpass filter would be preferred but controlling the inductance to a sufficiently low level is difficult as part of a manufacturing operation. Therefore, a resonant circuit is usually provided in series with the highest bandpass frequency comb-line filter as it is with the intermediate frequency comb-line filter. The lowest frequency bandpass filter is preferably connected without any series capacitance to the connecting block 47′ because of the better characteristics provided, but a series resonant circuit could be provided there as well, within the scope of the present invention, if necessary.

If more channels are added to the multiplexer, additional comb-line filters passing different frequency bands are also connected to the connecting block 47′ in a manner that a series resonant circuit is provided as an input to all of the filters except perhaps, for the lowest and highest frequency band filters, as previously discussed.

Figure 3:
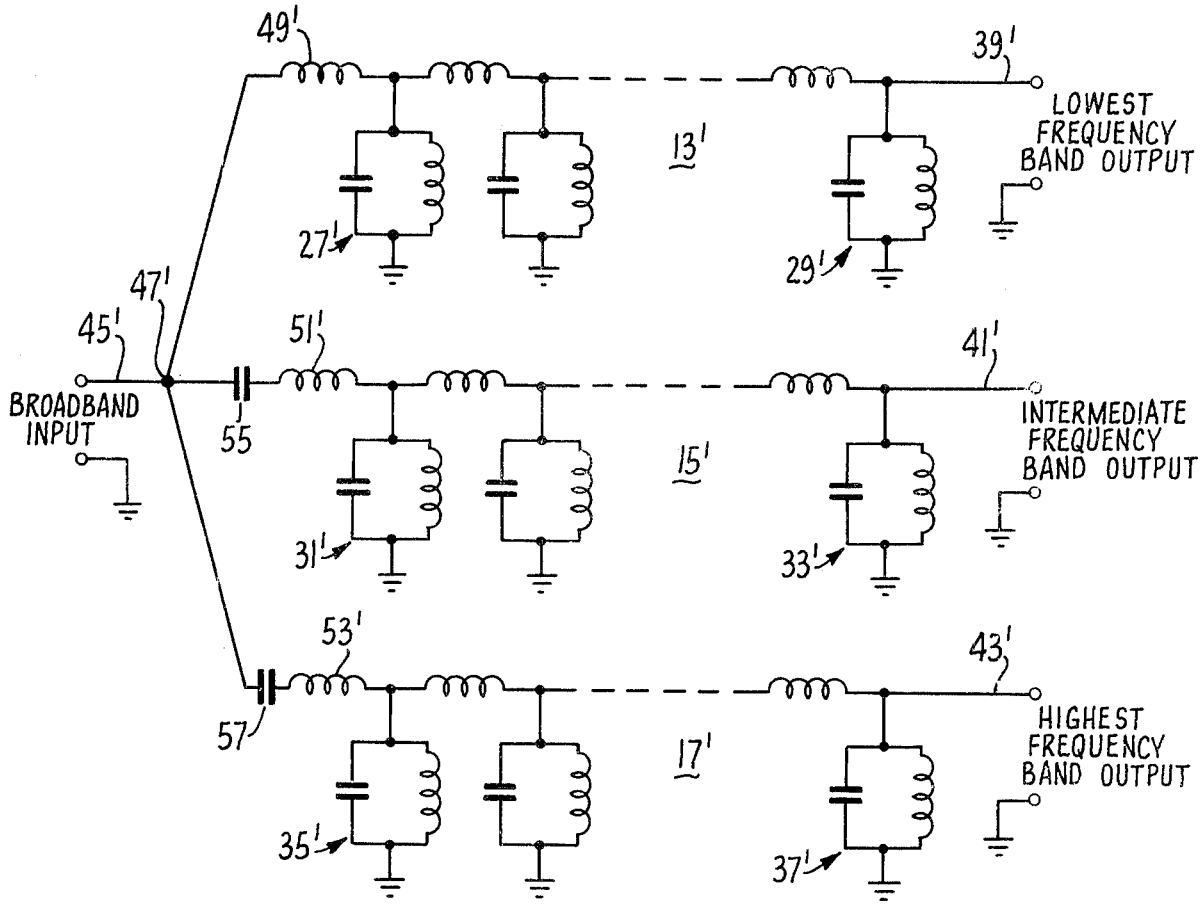
FIG. 3 is an electrical circuit schematic diagram of a multiplexer according to the present invention as embodied in the device of FIG. 2.

FIG. 3 is an equivalent electrical schematic circuit diagram of the multiplexer described with respect to FIG. 2. The electrical equivalent components shown in FIG. 3 are given the same reference number as the actual mechanical implemented components shown in FIG. 2, for ease of reference.

Figure 4:
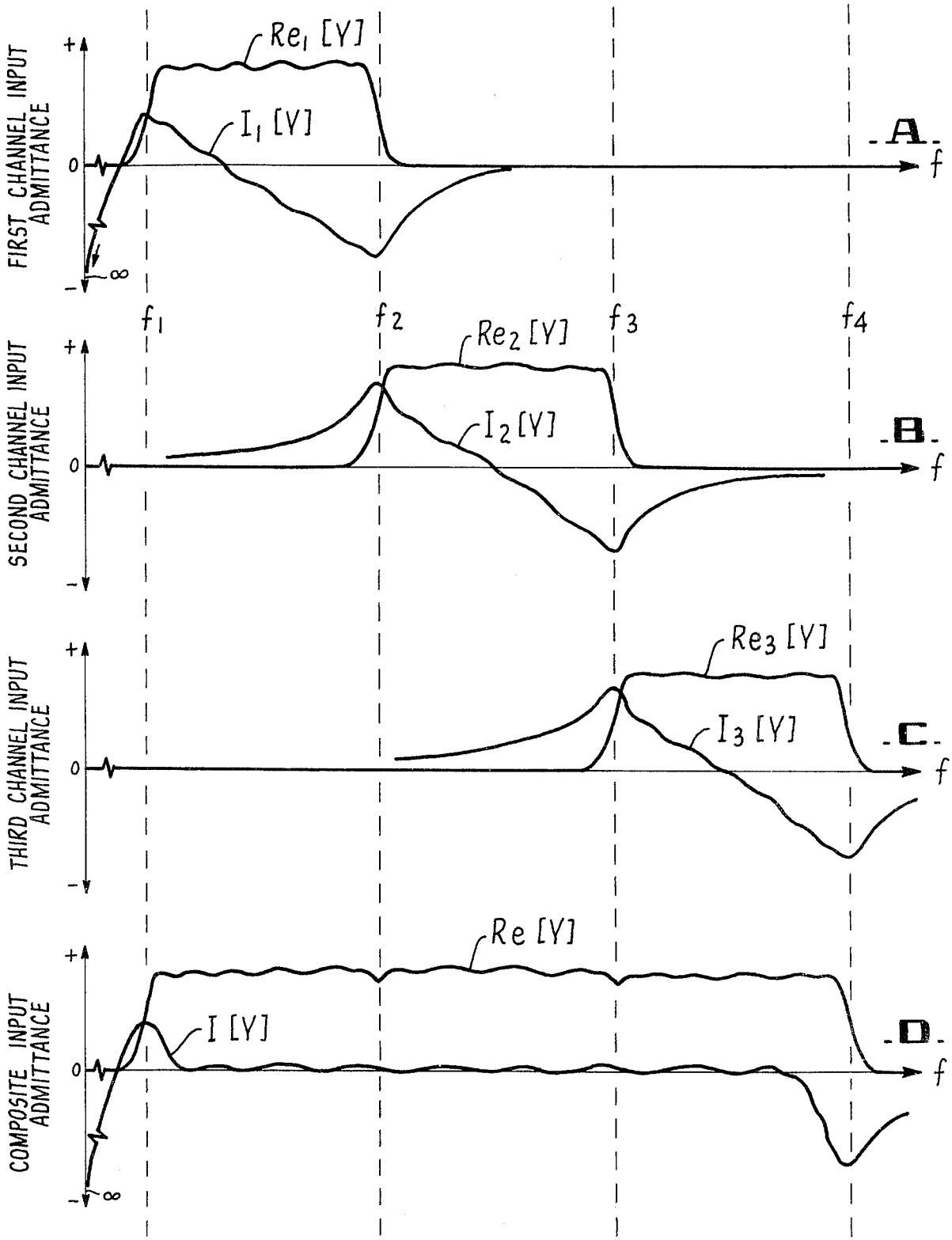
FIG. 4 illustrates the input admittances of the filters of FIGS. 2 and 3 and their individual parallel filter components, as a function of frequency.

FIG. 4 shows exemplary input admittance characteristics for the multiplexer and its individual comb-line filters of FIGS. 2 and 3. FIG. 4A shows, as a function of frequency, the input admittance to the first channel alone, looking from the common input connecting block 47' to the conductor 49' and resonating elements 27' through 29' of the lowest frequency comb-line bandpass filter. The curve $Re_1[Y]$ of FIG. 4A illustrates the real component of the complex admittance. The curve $I_1[Y]$ illustrates the imaginary component.

Similarly, FIGS. 4B and 4C each show the same information, respectively, for the intermediate (second) and highest (third) frequency channel input admittances. FIG. 4D shows the performance of the multiplexer of FIGS. 2 and 3 by representing its complex input admittance as viewed from the input conductor 45'.

It will be noted from FIG. 4D that the filter of FIGS. 2 and 3, utilizing the present invention, has a substantially flat admittance between the lowest input frequency $f_1$ and the highest input frequency $f_4$ for which the multiplexer is designed. The composite characteristics of FIG. 4D are the sum of those of each of the individual channels since the channels are connected in parallel. The first channel contributes to the overall multiplexer input characteristics between the frequencies of its comb-line bandpass between $f_1$ and $f_2$ (FIG. 4A), the second channel between the frequencies $f_2$ and $f_3$ which is the bandpass of the second comb-line filter (FIG. 4B) and the third is responsible for the characteristics between the frequencies $f_3$ and $f_4$ (FIG. 4C) which is the bandpass of the third and highest frequency comb-line filter.

The significant advantage of providing the particular input to each of the filters from the common multiplexer input as illustrated in FIGS. 2 and 3, is that the multiplexer imaginary component of the input admittance is substantially zero over the entire bandwidth of the device, as shown in FIG. 4D (curve I[Y]). The imaginary components of each of the separate channels as shown in FIGS. 4A, 4B and 4C, are combined in a manner that the peak of one is cancelled by an opposite polarity peak of the other, at least at the intermediate frequencies.

If the example multiplexer of FIGS. 2 and 3 is altered to include a capacitance input connection of the line 49' to the common input, with a resulting tuning of the series capacitance and inductive circuit to resonate within the bandpass of its associated comb-line filter, the positive peak of the imaginary component of the input admittance of FIG. 4A would increase somewhat, thus causing the positive peak of the imaginary component of FIG. 4D to increase somewhat. That is why it is preferable to omit the capacitive coupling from the lowest frequency channel, but if it is desired to be included for some reason the multiplexer will still perform with improved characteristics. Omission of this capacitance obviously optimizes the desired characteristics. Similarly, if the resonant circuit is omitted from the highest channel by providing only a capacitive coupling therewith, by minimizing as much as possible the inherent inductance of the conductor connection, the imaginary component in FIG. 4C, and thus the high end of that component of the composite FIG. 4D, will be further improved somewhat but either way superior performance characteristics result. The provision of the series resonant circuit between the common junction 47' and each intermediate frequency bandpass filter (only one such intermediate frequency filter 15' is shown in the example of FIGS. 2 and 3 but many may be employed) is principally responsible for cancellation of the imaginary admittance component peaks in the mid-band region in a manner that the resultant imaginary component is substantially zero.

The lowest and highest frequency filters of a multiplexer of the type described with respect to FIGS. 2–4 may be, alternatively, of low pass and high pass types, respectively. But the intermediate frequency filters would remain of the band-pass type.

The structure as described with respect to FIGS. 2, 3 and 4 provides a maximum improvement when the lowest frequency $f_1$ of the input frequency band for which the multiplexer is designed is in excess of 100 MHz and when the band edge ratio (that is, the ratio of the $f_4$ frequency to the $f_1$ frequency) is greater than 2. It is with multiplexers having these characteristics, as are being demanded more and more, that the existing techniques prior to this invention have been unable to satisfy. It will also be noted that this is accomplished without any parallel shunting resonant circuit or other components connected across any of the inputs ahead of the individual comb-line filters. Nor is any output series capacitance required.

Figure 5:
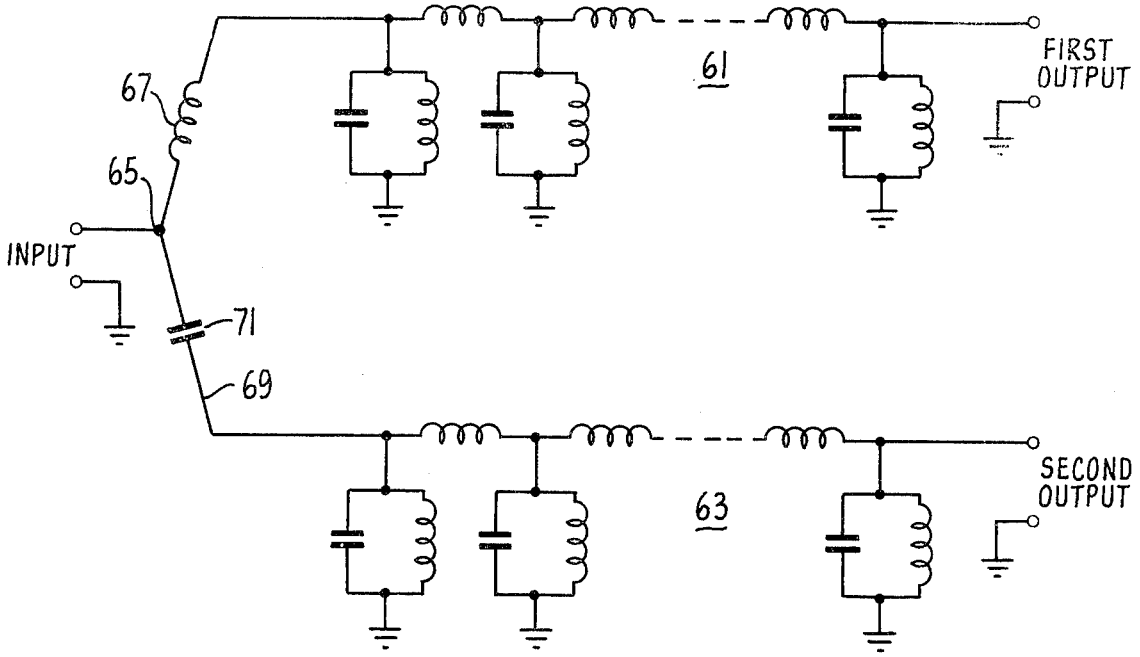
FIG. 5 is a schematic electrical equivalent circuit diagram of a diplexer utilizing another aspect of the present invention.

Referring to FIG. 5, a diplexer equivalent circuit is illustrated utilizing some of the same concepts underlying the multiplexer aspect of the present invention described with respect to FIGS. 2–4. Two comb-line filters 61 and 63 are designed to pass adjacent but distinct microwave frequency bands. The first comb-line filter 61 has its input resonator connected to a common multiplexer input junction 65 by a line 67 having some series inductance. The second and higher frequency comb-line filter 63 is connected to the common terminal 65 by a conductor 69 having as close to zero series inductance as is possible. The conductor 69 is capacitively coupled (illustrated by a capacitor 71) to the common input junction 65. Such a diplexer also has improved input admittance characteristics by having its imaginary component equal to substantially zero throughout the bandpass of the two comb-line filters 61 and 63 in combination.

It will be recognized that although the multiplexers and diplexer have been described herein as separators by way of specific examples, it will be recognized that they are reciprocal devices; they can be used as combiners as well. For example, if individual signals within the bandwidths of the comb-line filters 13', 15' and 17' of FIG. 2 are separately applied to the respective conductors 39', 41' and 43', a combined broad band microwave signal will be a resulting output in the conductor 45'.

Although specific examples illustrating the various aspects of the present invention have been described in some detail, it will be understood that the invention is entitled to protection within the full scope of the appended claims.

I claim:

1. In a microwave multiplexer having three or more comb-line filters with one end of each connected to a common junction, each filter passing distinct but adjacent portions of a microwave frequency spectrum, an improved coupling of said one end of each comb-line filter to said common junction wherein a resonant circuit is provided in series therebetween for at least one comb-line filter or filters having pass bands with frequency portions intermediate of the highest and lowest of said adjacent portions, each of said resonant circuits having a resonance frequency within a pass band of its associated comb-line filter.

2. The improved multiplexer according to claim 1 wherein the comb-line filter having a pass band corresponding to the lowest of said adjacent portions of the microwave frequency spectrum omits any series capacitance from its coupling between its said one end and said common junction, thereby omitting any series resonant circuit therefrom.

3. The improved multiplexer according to claim 1 wherein each comb-line filter with a frequency pass band portion greater than the lowest portion includes a series resonant circuit connected between the common junction and said one end of the filter and having resonance at a frequency within its pass band.

4. The improved multiplexer according to claim 1 wherein the comb-line filter having the highest pass band frequency portion has its said one end connected through a series capacitance to the common junction without providing resonance within that filter's pass band.

5. The improved multiplexer according to claim 1 wherein the comb-line filters are characterized by passing said distinct adjacent portions of a microwave frequency spectrum at frequencies in excess of 100 MHz and with a ratio of the highest to lowest frequency passed by all of said three or more comb-line bandpass filters being greater than two.

6. The improved multiplexer according to claim 1 wherein said multiplexer omits any shunting elements external of the comb-line filter between the common junction and a common potential.

7. The improved multiplexer according to claim 1 wherein another end of each comb-line filter is connected directly to a separate terminal without any series capacitance therebetween.

8. In a microwave multiplexer having a plurality of comb-line bandpass filters connected with their inputs to receive a broad band signal at frequencies greater than 100 MHz from a common input, each filter passing substantially different but adjacent portions of a microwave spectrum presented at said common input, an improvement coupling the input of each comb-line filter to said common input wherein a series resonant circuit is provided between the common input and at least each of the comb-line filters having pass bands above the lowest of said pass band frequency portions, each of the resonant circuits having a minimum impedance at a frequency within the pass band of its associated comb-line filter and a high impedance within the pass bands of the other filters.

9. The improved multiplexer according to claim 8 wherein the comb-line filter having the lowest frequency portion pass band is connected to the common input without any series capacitance therebetween, thereby omitting any series resonant circuit therefrom.

10. A microwave frequency multiplexer, comprising:

a plurality of comb-line bandpass filters having adjacent microwave frequency pass bands extending over a composite spectrum that all lies at frequencies greater than, 100 MHz, a common junction contact block, a wire connected between a resonator at one end of each of the comb-line filters and said contact block, thereby introducing an inductive coupling between one end of each of said comb-line filters and the contact block, and each of the wires leading to the comb-lines having pass bands exceeding the lowest pass band being connected to said block by insertion of an end thereof into a hold of said block in an electrically non-contacting relationship therewith, thereby forming a capacitive connection to the common junction block, said capacitive connections being made to the block for at least each of the comb-line filters having a pass band intermediate of the lowest and highest bands of said spectrum such that each capacitance forms with its associated inductance of the wire connection a resonant circuit having a minimum impedance at a frequency within the pass band of its associated comb-line filter and a high impedance within the pass bands of the other filters.

11. The multiplexer according to claim 10 wherein the connecting wire to the comb-line having the lowest pass band is solidly and electrically connected with said contact block in a non-capacitive manner.

12. A method of separating a microwave frequency spectrum over 100 MHz in frequency from a common signal source, comprising the steps of:

providing a plurality of comb-line filters each having adjacent microwave frequency pass bands that extend over portions of said microwave spectrum, and passing said common signal from the common input through individual impedances to the inputs of each of the comb-line filters, including the step of passing the signal to each of the comb-line filters having pass bands in excess of the minimum bandpass frequencies through a series impedance that includes a resonant circuit having a resonant frequency within the pass band of the associated comb-line filter.

13. A microwave diplexer, comprising:

a common terminal, a first comb-line microwave filter having a first defined microwave frequency pass band that lies entirely above 100 MHz, a second comb-line microwave filter having a second defined microwave frequency pass band that is immediately adjacent to and higher in frequency than said first pass band, a non-capacitive inductive coupling from said common terminal to a first resonant element of said first filter, and a series capacitive coupling from said common terminal to a first resonant element of said second filter.

* * * * *

UNITED STATES PATENT OFFICE

CERTIFICATE OF CORRECTION

Patent No. 4,091,344 Dated May 23, 1978

Inventor(s) Peter Myers La Tourrette

It is certified that error appears in the above-identified patent and that said Letters Patent are hereby corrected as shown below:

Column 8, line 15, "hold" should read --- hole ---.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*